United States Patent [19]

Williams

[11] 4,067,566

[45] Jan. 10, 1978

[54] AUTOMATIC STATIONERY HANDLING METHOD AND APPARATUS

[75] Inventor: Malcolm J. Williams, Rocky River, Ohio

[73] Assignee: Feeder One, Inc., Cleveland, Ohio

[21] Appl. No.: 676,126

[22] Filed: Apr. 12, 1976

[51] Int. Cl.[2] ..... B65H 5/00

[52] U.S. Cl. ..... 271/2; 271/6; 271/35; 271/227; 271/265; 197/130

[58] Field of Search ..... 271/2, 4, 6, 35, 265, 271/227; 197/130

[56] References Cited

U.S. PATENT DOCUMENTS

| | | | |
|---|---|---|---|
| 881,126 | 3/1908 | Hutches | 197/130 |
| 1,182,052 | 5/1916 | Stocking | 197/130 |
| 2,111,619 | 3/1938 | Fleming | 197/130 |
| 2,257,174 | 9/1941 | Langley | 271/2 |
| 2,289,011 | 7/1942 | Hall | 197/130 |
| 2,813,612 | 11/1957 | Berglund | 197/130 |
| 3,776,545 | 12/1973 | White | 271/4 |
| 3,790,159 | 2/1974 | Hatzmann | 271/265 X |
| 3,963,110 | 6/1976 | Hyland | 197/130 |

*Primary Examiner*—Richard A. Schacher
*Attorney, Agent, or Firm*—Watts, Hoffmann, Fisher & Heinke

[57] ABSTRACT

A method and apparatus are disclosed for automatically delivering discrete pieces of stationery, particularly envelopes, serially at a controlled rate from a stack of stationery into a programmable printing machine such as an automatic or a manual typewriter. Simultaneously, discrete pieces of stationery which have been printed by the typewriter are automatically fed back into the stack at the same rate at which they were delivered therefrom. The speed of operation of this automatic stationery handling apparatus is automatically coordinated to the speed at which discrete pieces of stationary can be processed by the programmable typewriter.

13 Claims, 5 Drawing Figures

AUTOMATIC STATIONERY HANDLING METHOD AND APPARATUS

BACKGROUND OF THE INVENTION

This invention relates generally to the field of paper handling, and more particularly to a method and apparatus for automatically delivering discrete pieces of stationery from a stacked supply to a printing machine, such as a typewriter, and then transporting printed pieces of the stationary from the printing machine back to the stacked supply.

Methods and apparatus for serially feeding discrete pieces of stationery to a machine are known in the art. In addition to the conventional manual feeding method, apparatus are known which semi-automatically feed envelopes to typewriters from a stacked supply. U.S. Pat. Nos. 1,707,080 and U.S. Pat. No. 2,257,174 are illustrative of such prior art semi-automatic envelope feeding apparatus. In both of these apparatus the operator of the typewriter must take some affirmative action such as rotating the typewriter platen or also operating a lever in order to advance envelopes to the typewriter.

The advent of programmable printing machines such as automatic typewriters has been very popular among businesses and organizations which do mass mailings. Such organizations and businesses desire to send the same letter to each of a large number of recipients. However, these organizations want their letters and envelopes to be individually typed rather than being printed, xeroxed, or similarly duplicated so that each letter will have a "personalized" appearance. If these "personalized" letters and envelopes were to be typed by individual typists rather than automatically, the costs would be prohibitive. When an automatic typewriter is employed, once programmed, it may be left unattended to rapidly type error-free "personalized" letters and envelopes as desired at substantial savings of labor.

The result of this popularity of automatic programmable typewriters has been the creation of a need for more rapid methods and means of feeding stationery to such typewriters with an absolute minimum amount of human interposition. One answer has been the use of continuous form stationery which comprises an elongate web either comprising or supporting the stationery. Continuous form envelopes in one popular arrangement comprise a plurality of individual envelopes generally mounted in spaced relationship and aligned on an elongate web. The web may be passed through the automatic typewriter and positioned around the typewriter platen so that envelopes on the web are addressed as they are conveyed over the platen with the web. Such continuous form envelopes have some decided disadvantages. As contrasted with conventional envelopes of a similar size, this arrangement of continuous form envelopes today costs approximately five times as much. Additionally, the arrangement requires that the envelopes be disposed in spaced-apart relation along the web. This spacing of the envelopes along the web is translatable into the machine time involved in rotating the platen to advance the web from one envelope to the next adjacent one. Continuous form envelopes have been developed where the individual envelopes have been overlapped to some extent. Such overlapping permits the automatic typewriter to finish the bottom line on one envelope and then start typing the first line of the next succeeding envelope on the web, while requiring a smaller platen advance than required with the popular continuous form envelopes noted above. The overlapping, continuous form envelopes have not been well received by mass mailers. While there is a savings in machine operation time in the use of such overlapping continuous form envelopes, the manner in which such envelopes have been mounted has necessitated that an unattractive, ragged appearance be produced when such envelopes were removed from their supporting web. This ragged appearance detracts from the "personalized" letter.

SUMMARY OF THE INVENTION

It is an object of this invention to provide a method and apparatus for serially supplying unconnected or discrete pieces of conventional stationery from a source of supply to an automatic or manually controlled typewriter which will type and then serially emit each typed piece for transport to a receiving station.

It is a further object of this invention to provide a method and apparatus for serially supplying a plurality of conventional detached envelopes to an automatic manually controlled typewriter for addressing and then automatically transporting the typed envelopes back to the source of supply.

In accordance with a preferred embodiment of this invention a method is disclosed for serially supplying a plurality of discrete pieces of stationery to a work processing machine, such as an automatic typewriter or the like. The method comprises the steps of providing a stack of stationery, e.g., envelopes, intermittently feeding one envelope at a time to a ready station, periodically releasing an envelope from the ready station into the machine in response to withdrawal of a finished envelope from the machine, and automatically removing and transporting the envelopes one at a time from the machine.

In accordance with another aspect of this invention, there is provided an apparatus for feeding envelopes or the like to a work processing machine comprising a magazine for holding a stack of discrete pieces of stationery such as envelopes, structure including a releasable gate defining a ready station, the machine being disposed to receive envelopes released from the ready station, a feeding system for extracting one envelope at a time from the stack and transferring it to the ready station, another feeding system for receiving envelopes withdrawn from the machine and transferring them to a receiving station, and an actuating arrangement for operating the gate in response to withdrawing and feeding each envelope from the machine.

As contemplated in one preferred embodiment of the invention, the envelopes are extracted one at a time from the magazine and transferred to the ready station by a motor driven conveyor. The conveyor is actuated in response to removal of an envelope from the ready station by opening of the gate. The presence of each envelope from the machine is detected and the gate is opened in response to such detection. Preferably, a belt conveyor system is provided for transferring the processed envelopes back to the original magazine, and this conveyor system also is actuated in response to detection of the presence of an envelope discharged by the machine.

Other objects and a fuller understanding of the invention will be had from the following detailed description and the accompanying drawings.

DESCRIPTION OF THE PREFERRED EMBODIMENT

Figure 1:
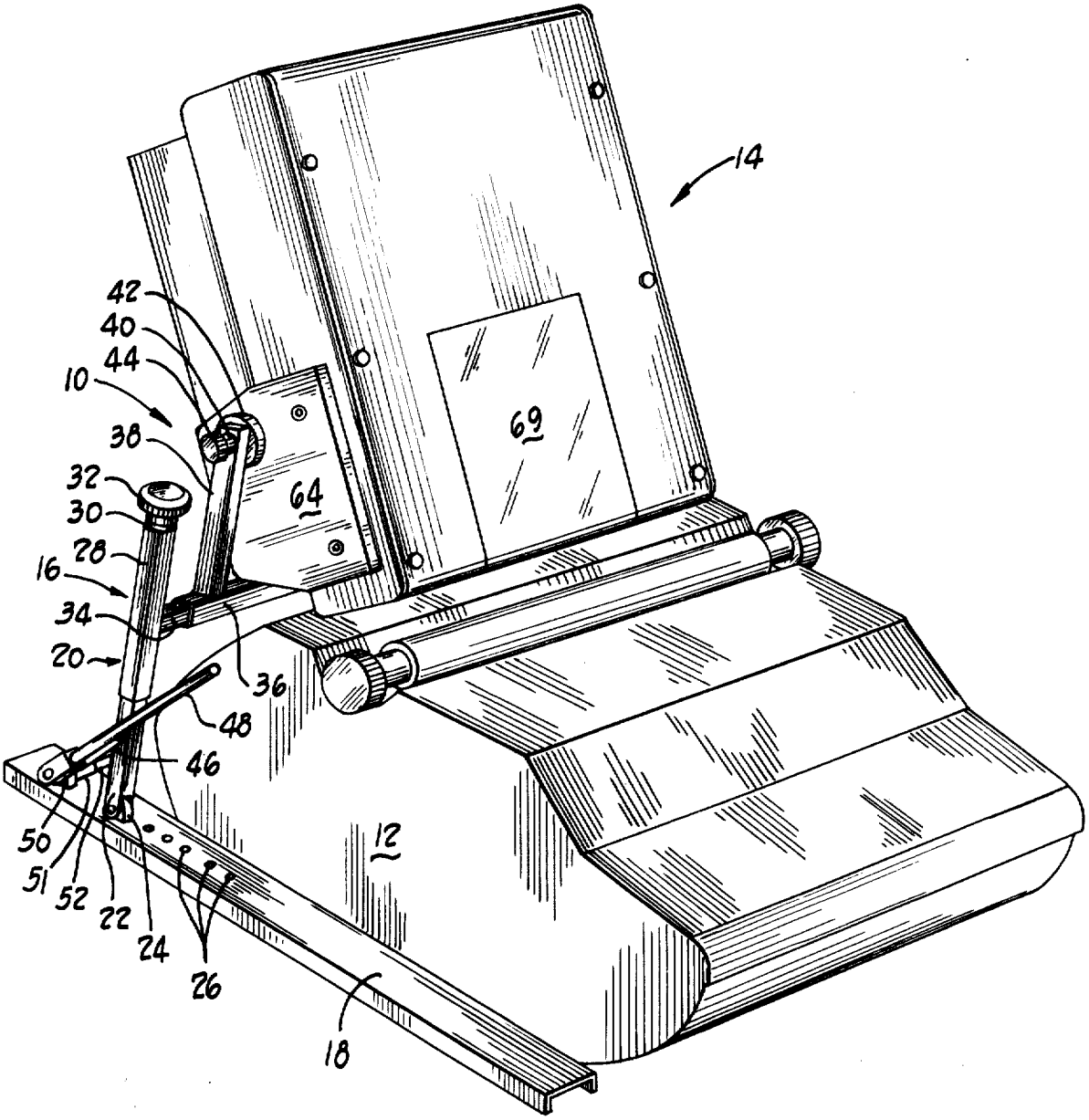
FIG. 1 is a perspective view illustrating the stationery handling apparatus incorporating features of this invention disposed in operative relation to an automatic typewriter.

Referring to FIG. 1, a stationery handling apparatus 10 incorporating features of this invention is shown supported above a schematically illustrated work processing machine, such as a programmable printing machine 12 which may be an automatic typewriter. While not intended to be limiting of its scope or applicability, the present invention is disclosed as being embodied in an apparatus for feeding envelopes to and from the typewriter 12. The stationery handling apparatus 10 comprises a stationery supply and transport assembly 14 mounted by a swing-out mounting assembly 16 which adjustably supports the assembly 14 in either an upright position over the typewriter 12 or in a position displaced from the region above the typewriter.

The swing-out mounting assembly comprises a pair of spaced, aligned side brackets 18 which are inverted channel members. Each side bracket 18 pivotally mounts a telescoping support sub-assembly 20. Each support sub-assembly 20 comprises an inner tubular member 22 pivotally mounted to a pivot block 24 secured to the respective bracket 18 at one of the series of holes 26. Each inner tubular member 22 supports an outer tubular member 28 for telescopic movement. Such movement may be imparted to the member 28 by a freely rotatable threaded rod 30 in the outer tubular member 28. The rod 30 is threadedly received in a cap (not shown) mounted within the member 22. Rotation of the rod 30 through the cap imparts telescopic movement to the member 28 with respect to the tubular member 22. A knob 32 may be provided at the exposed end of the threaded rod 30 exterior of member 28 to faciliate turning.

A laterally extending tubular portion 34 is brazed to each of the outer tubular members 28. With the brackets 18 disposed parallel to each other on opposed sides of the typewriter 12, the outer tubular members 28 are oriented so that the tubular supports 34 extend laterally toward each other. A tubular cross-piece 36 is provided to connect the telescoping support sub-assemblies 20. Each end of the tubular cross-piece 36 slidably receives one of the laterally extending tubular supports 34.

Figure 2:
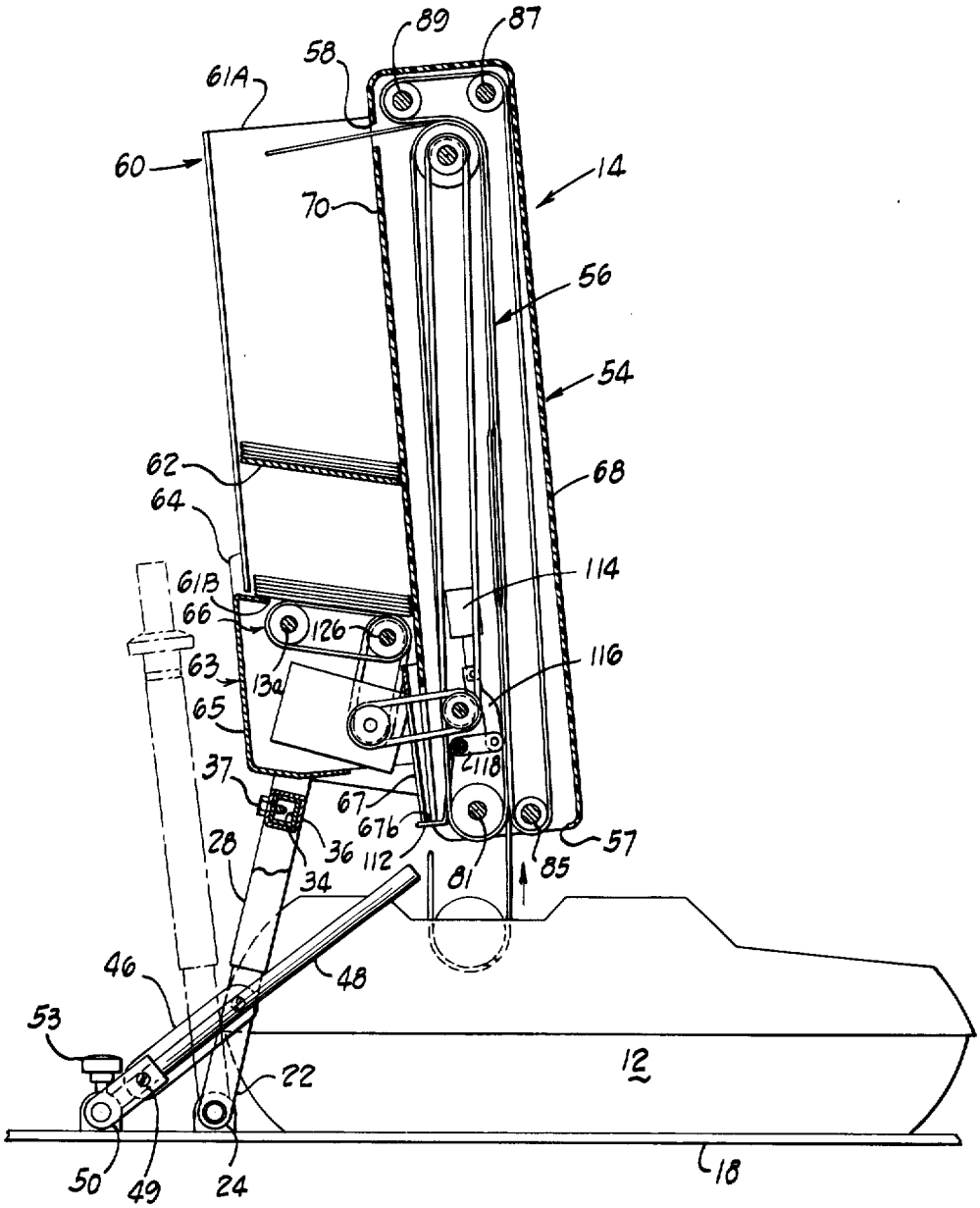
FIG. 2 is a vertical cross-sectional view of the handling apparatus of FIG. 1.

The cross-piece 36 may be locked at each of its ends to the respective tubular supports 34 by conventional fastening means such as sheet metal screws 37 threaded through one wall of both tubular members (see FIG. 2). The cross-piece 36 is provided with a pair of spaced, transversely extending supports 38. The cross-piece 36 is mounted by the laterally extending supports 34 so that the outwardly extending supports 38 extend in a generally upward direction when the assembly 16 is disposed in an upright position over the typewriter 12. The stationery supply and transport assembly 14 is mounted to the swing-out mounting assembly 16 by suspending the supply and transport assembly 14 from the outwardly extending supports 38. Each support 38 mounts a threaded member 40 which engages a plate or boss 42 on the side of the adjacent stationery supply and transport assembly 14. The treaded member 40 may be provided with a knob 44 to facilitate threading of the member 40 into the plate 42.

The swing-out capability of the mounting assembly 16 is provided by a link-lever sub-assembly pivotally mounted to each bracket 18. Each such link-lever sub-assembly comprises an elongate link 46 pivotally mounted at one end to the inner tubular member 22. The link 46 is extended back along the bracket 18 away from the typewriter 12 and is pivotally connected at its other end to a lever or handle 48 intermediate its ends by a pin 49. The handle 48 is itself pivotally mounted to a pivot block 50 attached to the frame 18. In FIG. 1, the link-lever assembly is illustrated in its extended position, thereby locking the swing-out assembly 16 with the assembly 14 in an upright position over the typewriter 12. To move the assembly 14 backward from its position over the typewriter 12, it is merely necessary to lower the handle 48 downward toward the bracket 18 to collapse the handle-link connection. Once the handle-link connection is collapsed, backward pivoting of the assembly 16 and supported assembly 14 away from the typewriter can occur. (See FIG. 2).

Rigidity of the support assembly 16 is achieved by providing a lower lateral rod 51 which is mounted to one of the pivot blocks 50. A lower tubular cross-piece 52 is connected to the other pivot block 50. The lower tubular cross-piece 52 extends toward and slidably receives rod 51. A conventional locking member 53 (See FIG. 2) is then employed to lock the telescoped rod 51 and tubular cross-piece 52.

The disclosed mounting assembly 16 is advantageous because it permits the stationery feeding and receiving apparatus 10 to be utilized with a variety of sizes of programmable printing machines. Varying width machines are accommodated by moving the tubular cross-pieces 36 and 52 with respect to their laterally extending supports 34 and 51, respectively, so as to laterally adjust the position of the side brackets 18. Varying height machines are accommodated by rotating the knobs 32 so as to vertically adjust the tubular cross-piece 36 and structure supported thereby. The provision of holes 26 permits the assembly 16 to be adjustably positioned along the length of brackets 18 in order to accommodate various automatic typewriters having carriages of varying depth or having carriages which are positioned at different locations with respect to the back of the machine.

The stationery supply and transport assembly 14 is illustrated in FIG. 2 in its upright position above the typewriter 12. In the illustrated upright position, the stationery exit path from the assembly 14 coincides with the stationery entry path into the typewriter 12 and the exit path from the typewriter coincides with the entry path back into the supply and transport assembly.

Figure 3:
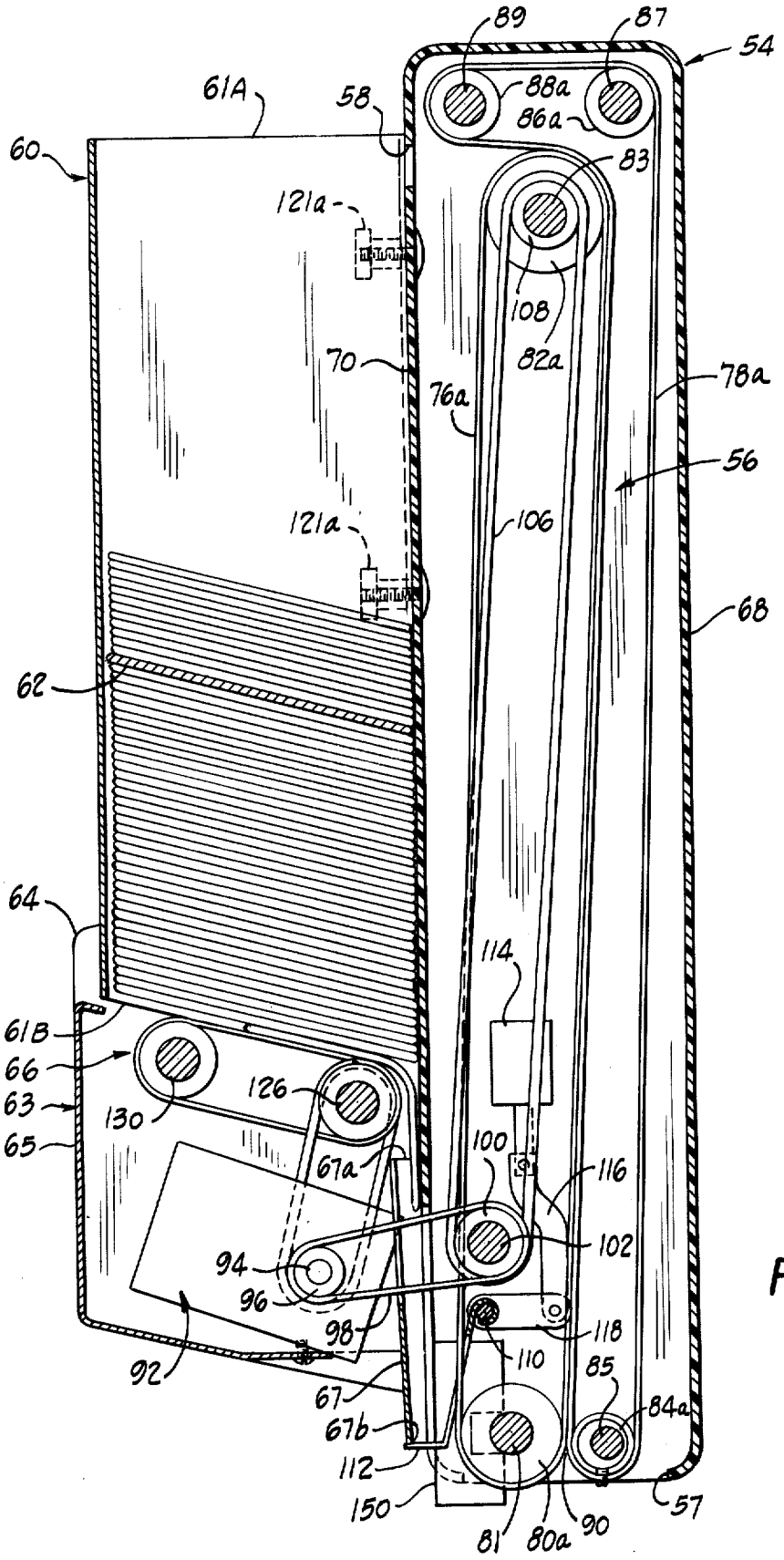
FIG. 3 is a sectional view illustrating the stationery transport and supply assembly of the stationery handling apparatus shown in FIG. 2 in enlarged scale.

Generally, the stationery supply and transport assembly 14, shown in enlarged scale in FIG. 3, comprises an adjustable stationery supply and storage magazine 60 which contains a stack of envelopes. The lower portion of the stack consists of envelopes yet to be typed. The upper portion of the stack is formed by envelopes which have already been typed and returned to the magazine for storage. The respective typed and untyped envelope stack portions are separated in the magazine by a separator plate 62. The magazine 60 is mounted to the upper portion of the rear wall 70 of an elongate housing 54. A small housing 63 supports a conveyor belt delivery system 66 in contact with the lowermost envelope supported in the magazine 60. The delivery system 66 serially removes from the magazine 60 each untyped envelope with which it is in contact and feeds each such piece into a conveyor or holding well 67 mounted to the wall 70 within the housing 63. The well 67 has top and bottom openings 67*a*, 67*b* aligned with the envelope path from the magazine to the typewriter. The bottom opening 67*b* is selectively blocked or unblocked by a gate 112 to be more fully described later. The well 67 is an advanced holding position for a yet to be typed envelope immediately adjacent the stationery entry path into the typewriter 12. When the typewriter is ready to receive the envelope already in the holding well 67, that envelope is released from the well 67 by the gate 112 and enabled to move along the stationery entry path into the typewriter 12. Typed envelopes being emitted by the typewriter 12 are received through a bottom wall opening 57 in housing 54. Such envelopes are engaged by an elevator assembly 56 mounted in the housing 54 and transported upward through the housing 54 to a slot 58 in the rear wall of the housing. Such typed pieces of stationery are then ejected through the slot 58 into magazine 60.

Figure 5:
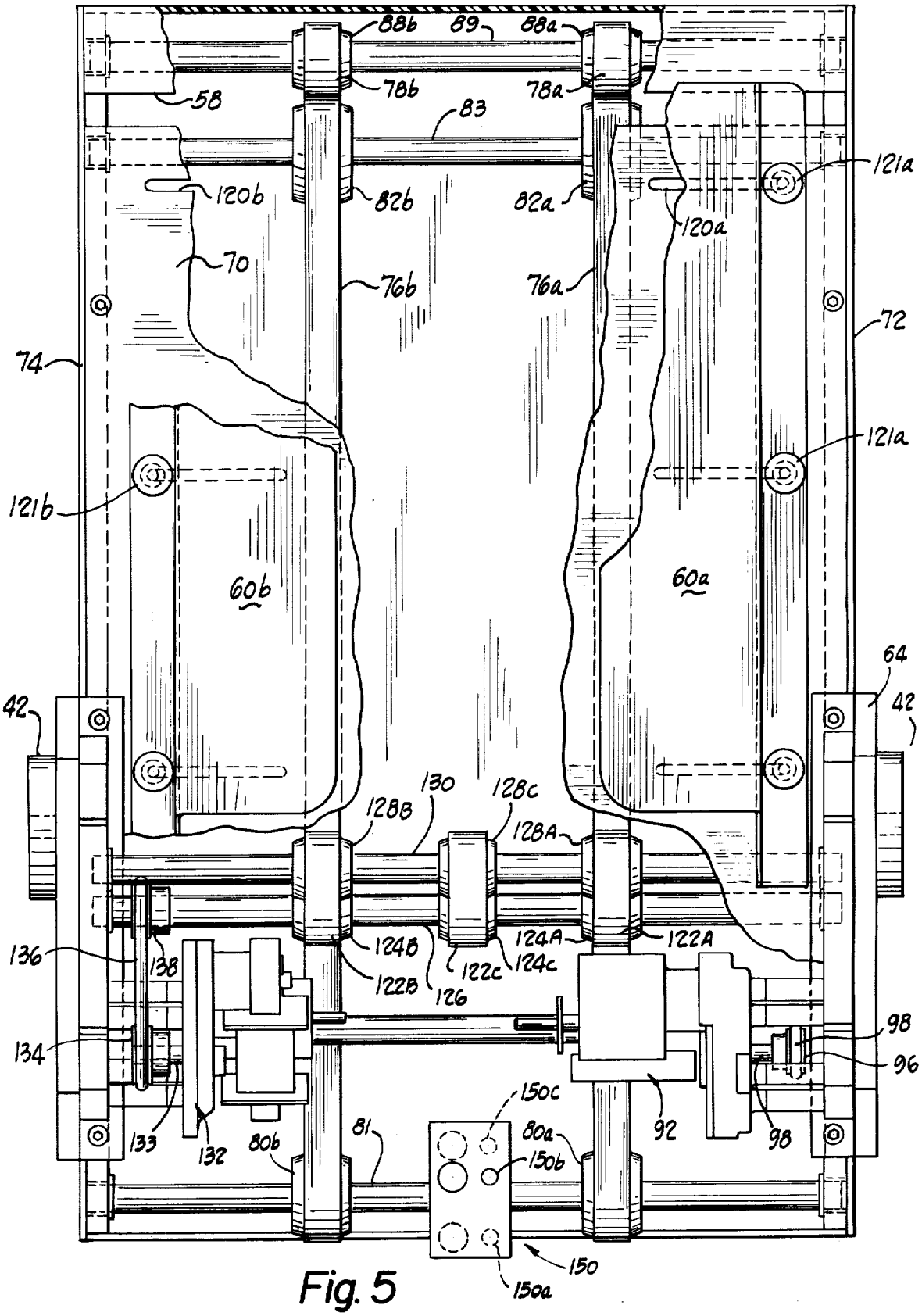

Referring to FIG. 5, it is seen that the magazine 60 comprises a pair of right angle members 60*a* and 60*b* mounted in a facing relation to the back wall 70 of the housing 54. The angle members 60*a*, 60*b* each comprise a first vertical wall which extends outward from the back wall 70 of the main housing 54. Each angle member also comprises a second vertical wall which extends laterally from the outer end of the first wall, inward toward the facing angle member. The top of the magazine 60 is open at 61*a* so that a stack of untyped envelopes can be inserted into the magazine or a stack of typed envelopes can be removed therefrom. The bottom of the magazine is open at 61*b* so that the lowermost envelope communicates directly with the conveyor belt system 66 for delivery into the typewriter.

As shown in FIG. 5, the angle members 60*a*, 60*b*, are mounted for lateral adjustment. Such lateral adjustment is provided by two spaced sets of elongate, horizontal slots 120*a*, 120*b* in opposed sides of the back wall 70. Fasteners 121*a*, 121*b*, extend through the slots 120*a*, 120*b* to connect each of the members 60*a*, 60*b* to the back wall 70. Lateral adjustment of the facing angle members 60*a*, 60*b* with respect to each other is possible by loosening fasteners in order to effect such movement and then tightening the fasteners when desired positioning of the angle members 60*a*, *60b* with respect to the back wall 70 has been effected.

The small housing 63 comprises a pair of side brackets 64 which are mounted to the sidewalls of the housing 54 and which support a C-shaped housing cover 65. The side brackets 64 each support one of the plates 42 for mounting on the swing-out mounting assembly 16.

As shown in FIGS. 3 and 5, the conveyor belt delivery system 66 disposed in housing 63 comprises three conveyor belts 122*a*, 122*b*, and 122*c*. Each of the conveyor belts 122*a*, 122*b*, 122*c* is respectively mounted about pulley 124*a*, 124*b*, 124*c* supported on a shaft 126 and about pulleys 128*a*, 128*b*, 128*c* on a shaft 130. Motion is imparted to the conveyor belt delivery system 66 by a motor 132 (see FIG. 5) mounted in the housing 64. The drive shaft 133 of the motor 132 supports a pulley 134. A driving belt 136 is entrained around the pulley 134 and a pulley 138 mounted on the shaft 126. Activation of the motor rotates the lower pulley set 124*a*, 124*b*, and 124*c* to effect movement of the belts and displacement of an envelope supported thereon from the magazine 60 into the holding well 67.

Figure 4:
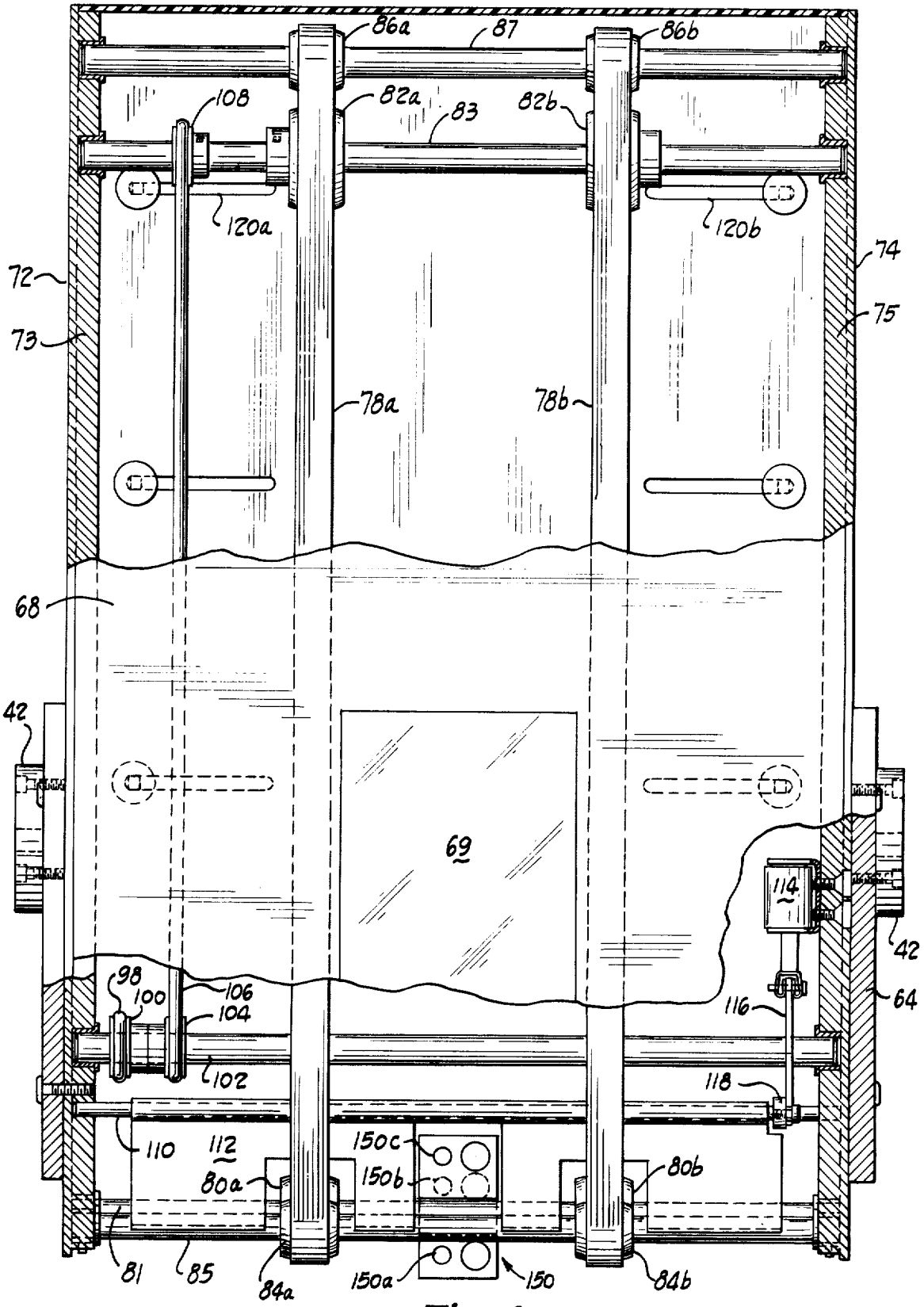
FIGS. 4 and 5 are elevation views, partly broken away, which illustrate respectively the front and back of the stationery transport and supply assembly shown in FIG. 3. Some parts of the assembly are eliminated from these views for purposes of clarity.

Referring to FIGS. 3–5, and particularly FIG. 4, the main housing 54 has a front wall 68 spaced from the backwall 70. The front wall 68 includes a window 69 which optically communicates with a portion of the path which typed envelopes follow as they are transported from the typewriter back to the magazine 60. This window permits an observer to monitor the typing on the envelopes. The housing 54 is also provided with end walls 72, 74. The end walls each support bearing blocks 73, 75 which in turn support the shafts rotating in the housing 54.

The elevator assembly 56 disposed within the main housing 54 comprises a pair of driving belts 76*a*, 76*b* which cooperate with a pair of driven belts 78*a*, 78*b* to transport envelopes or other stationery being processed substantially the length of the main housing 54. The driving belts 76*a*, 76*b* are mounted about lower supported pulleys 80*a*, 80*b* supported on a shaft 81 and about upper pulleys 82*a*, 82*b* supported on a shaft 83.

The pair of driven belts 78*a*, 78*b* are supported about three sets of pulleys. A lower pair of pulleys 84*a*, 84*b* are supported on a shaft 85 and are mounted adjacent the driving belt lower shaft supported pulleys 80*a*, 80*b*. Two pairs of upper shaft supported pulleys 86*a*, 86*b* and 88*a*, 88*b* are supported on respective shafts 87 and 89 at the top of the housing 54 adjacent the front and back walls 68, 70 respectively. This manner of supporting the pulley shafts 85, 87, 89 positions the mating belts 76*a*, 76*b* and 78*a*, 78*b* so that they engage each other along a line which is substantially the length of the housing 54 and which extends more or less from the bottom wall opening 57 to the rear wall exit slot 58. The lower shaft supported pulleys 80*a*, 80*b* and 84*a*, 84*b* are arranged so that their respectively supported belts 76*a*, 76*b* and 78*a*, 78*b* engage each other intermediate the adjacent pulleys to define a pinch point 90 proximate the opening 57 in the bottom wall of the housing 54. The arrangement of the upper shaft pulleys 86*a*, 86*b* and 88*a*, 88*b*, above and at either side of the pulleys 82*a*, 82*b* causes the driven belts 78 to follow the driving belts 76 part way around the circumference of pulleys 82*a*, and 82*b*. This partial wrap-around causes the belts 76*a*, 76*b*, and 78*a*, 78*b* to remain engaged until they reach a point proximate the rear wall exit slot 58. Discrete pieces of stationery such as individual envelopes being emitted by the typewriter 12 are directed upward into the pinch point 90 at which point they are engaged by the mating belts 76*a*, 76*b* and 78*a*, 78*b*. The mating belts transport the envelopes serially along their line of engagement to the region proximate the exit slot 58 through which the envelopes are then inserted into the magazine 60.

The driving belts 76*a*, 76*b* are shown to be powered by an electrical motor 92 mounted in the small housing 63. The motor drive shaft 94 mounts a pulley 96 around which a drive belt 98 is entrained. The drive belt 98 is also entrained around a pulley 100 mounted on a shaft 102 disposed in the main housing 54. The shaft 102 also supports a pulley 104 which entrains an intermediate drive belt 106. The drive belt 106 is also entrained about a pulley 108 which is mounted on drive shaft 83.

The housing 54 supports a shaft 110 which pivotally mounts the gate 112. The gate 112 is operable between a first condition wherein the gate closes off an opening 67*b* at the base of the holding well 67 and a second condition wherein the gate 112 moves out of blocking relation with the opening 67*b* to allow passage out of the holding well 67 of any envelopes or other discrete piece of stationery. Pivoting of the gate 112 about the shaft 110 is effected by a solenoid 114 mounted in the housing 54. The solenoid 114 is interconnected with the shaft 110 via a pair of links 116, 118. The link 116 is fixed at one end to the armature of the solenoid 114. The link 118 is fixed at one end to the shaft 110. The other ends of the links 116, 118 are pivotally interconnected. Activation of the solenoid 114 and corresponding movement of its armature effects movement of the link 116 with respect to the link 118 so as to pivot the gate 112 alternatively into and out of the path of stationery passing through the holding well 67.

In order to operate the apparatus, a sensing and control system is employed. The sensing system, shown in FIGS. 4 and 5, comprises three lamp and photosensor units 150*a*, 150*b*, and 150*c* disposed in a housing 150 placed within the housing 54 proximate the bottom opening 57. Since such sensing systems are conventionally available, this sensing system is shown only schematically. The units 150*a*, 150*b*, and 150*c* are operatively connected to the various motors by conventional control circuitry. A first lamp and photosensor unit 150*a* is disposed in the lower section of the housing 150 below the pinch point 90. The unit 150*a* detects the presence of an envelope or other piece of stationery being emitted from the typewriter 12 before that envelope reaches the pinch point 90. Unit 150*a* then signals conventional control circuitry connected to the motor 92. The elevator motor 92 is thereby activated to operate the elevator 56, and thus receive and remove the emitted envelope from the typewriter region. The same conventional control circuitry simultaneously activates the solenoid 114 so as to open the gate 112 and permit passage of an envelope or other piece of stationery from the holding well 67 to the typewriter 12 for printing.

The unit 150*b*, disposed above unit 150*a*, detects the absence of an envelope in the holding well 67. When the solenoid 114 is activated to permit the passage of an envelope from the holding well 67, the unit 150*b* signals conventional control circuitry connected to motor 132 for the conveyor belt delivery system 66. The system 66 then extracts the lowermost envelope in the magazine 60, and transfers that envelope into the holding well 67.

The third unit 150*c* disposed above the unit 150*b* fully within the housing 54, senses the presence of a typed envelope being transported by the elevator assembly 56. As long as such an envelope is sensed by unit 150*c* the conventional control circuitry will maintain the motor 92 operative and the elevator will keep transporting such an envelope upward. When that envelope moves out of the path of the unit 150*c* and when no succeeding envelope has yet moved into the path of unit 150*a*, the conventional control circuitry will deactivate the motor 92 and stop the elevator assembly 56.

By employing sensor unit 150*c* above sensor 150*a* to detect the presence of the same envelope and control the elevator assembly, it is assured that the elevator assembly will continue to operate until the envelope being transported is carried well past the pinch point 90 before the elevator 56 stopped.

Consequently, when the next succeeding envelope is being emitted from the typewriter toward the pinch point 90, the previously emitted envelope will have been moved well past point 90. The chances of fouling the elevator assembly with a plurality of envelopes at the entrance 57 to housing 54 will thus be minimized.

The motors 92 and 132 are chosen so that motor 92 operates at a substantially higher RPM than the motor 132. The elevator system 56 therefore will be able to receive an emitted envelope from the typewriter 12 and transport that envelope from the typewriter past both sensor units 150*a*, 150*c* before the conveyor delivery system 66 has an opportunity to eject an envelope from the magazine 60 into the holding well. The rapid passage of the emitted envelope past the units 150*a*, 150*c* will permit them to signal the related control circuitry that an envelope is no longer present so that the elevator assembly will be stopped and the solenoid 114 deactivated. Thus, the gate 112 will be closed before an unprinted envelope is ejected into the holding well. Once the envelope is ejected into the holding well by the system 66, passage of that envelope to the typewriter 12 is blocked by the gate 112 until another envelope has been typed by the typewriter and is being emitted to the elevator system.

It can be seen that the stationery handling apparatus operates in response to the typewriter. As the typewriter finishes typing one envelope, that typed envelope is removed and another untyped envelope is released into the machine. The speed of the motors 92 and 132 can be chosen to be sufficiently high that the stationery handling apparatus can feed envelopes to and remove envelopes from the typewriter as fast as the typewriter can process them. If it is desired to speed up the processing by the typewriter, the typewriter 12 may be set up initially with a series of overlapping envelopes in the typewriter. As each envelope is finished and emitted from the typewriter, a second, and perhaps even a third are already on the typewriter's platen waiting their turn to be typed. Meanwhile, another envelope is in the holding well 67 being delivered past the open gate 112 to the typewriter.

The sequence of removing an envelope from the supply and transport assembly 14 only as another envelope is returned thereto and the storing of typed and untyped envelopes in a single magazine permits a relatively constant number of envelopes to be stored in the magazine. Consequently, the load on the conveyor belt assembly 66 is always relatively constant. This narrow operating parameter gives rises to more consistent operation of the assembly 66 which does not have to meet a wide variety of operating conditions.

Many modifications and variations of the invention will be apparent to those skilled in the art in the light of the foregoing detailed disclosure. Therefore, it is to be understood that, within the scope of the appended claims, the invention can be practiced otherwise than as specifically shown and described.

What is claimed is:

1. A stationery feeding and receiving apparatus for use with an independently operatable printing machine having an existing stationery feed path with separate entry and exit paths, said feeding and receiving apparatus comprising:

a. a magazine for stacking discrete pieces of stationery and having an outlet in its base through which such discrete pieces of stationery may be dispensed,
b. feeding means for serially delivering discrete pieces of stationery to the machine, said feeding means comprising,
   i. a conveyor means,
   ii. ejector means to engage the lowermost piece of stationery stacked in the magazine for feeding the same to said conveyor means,
   iii. gate means disposed in said conveyor means and operable between a closed condition wherein a discrete piece of stationery ejected by said ejector means from said magazine is detained by said gate means and an open condition,
   iv. first sensing means for sensing the absence of a discrete piece of stationery in said conveyor means,
   v. control means responsive to said first sensing means for activating said ejector means to eject a discrete piece of stationery from said magazine,
c. receiving means for serially receiving discrete pieces of stationery discharged by the printing machine and transporting such pieces of stationery to a receiving station, said receiving means including,
   i. second sensing means for sensing the presence of a discrete piece of stationery being discharged by the printing machine along its exit path;
   ii. control means responsive to said second sensing means for activating said receiving means and for activating said gate means to its open condition; and
d. means for supporting said magazine, said feeding means, and said receiving means with said conveyor means aligned with the entry path of the printing machine and said receiving means aligned with the exit path of the printing machine.

2. The apparatus of claim 1 wherein said feeding means comprises conveyor belt ejector means disposed in the bottom of said magazine so as to engage the lowermost piece of stationery stacked in said magazine.

3. The apparatus of claim 1 wherein said receiving station is said magazine whereby a relatively constant amount of stationery is thereby maintained in said magazine.

4. The apparatus of claim 1 wherein said second sensing means comprises a pair of sensing units serially disposed in spaced relation along the path of the discrete pieces of stationery emitted by the machine.

5. The apparatus of claim 1 wherein said supporting means supports said magazine, said feeding means, and said receiving means as a unit, said supporting means being capable of adjusting the vertical position of said unit with respect to the machine.

6. The apparatus of claim 1 wherein said supporting means comprises a swing-out mounting assembly comprising:
a. a pair of brackets intended to be horizontally disposed on opposed sides of the machine, and
b. similar longitudinally adjustable telescoping members pivotally mounted to each of said brackets generally, said telescoping members mounting an adjustable laterally extending members for movement therewith, said laterally extending member supporting said magazine, said feeding means, and said receiving means for movement therewith as a unit between a first position removed from the vicinity of the printing machine and a second position proximate the vicinity of the printing machine, said horizontal brackets being adjustable relative to each other and each of said telescoping supports being axially adjustable to accommodate varying sized printing machines.

7. The apparatus of claim 1 wherein said supporting means supports said magazine, said feeding means, and said receiving means as a unit.

8. The apparatus of claim 7 wherein said magazine supporting means includes means for variably adjusting the width of said supporting means to enable positioning said unit above various width entry and exit paths.

9. The apparatus of claim 1 wherein said supporting means is adapted to support said feeding means and said receiving means for movement between a first position, wherein said feeding means and said receiving means are out of communication with the respective entry and exit paths of the printing machine, and a second position wherein said feeding means and said receiving means are in communication with the respective entry and exit paths.

10. A method of handling discrete pieces of stationery being fed to and emitted from a printing machine comprising the steps of:
a. stacking the discrete pieces of stationery external of the printing machine;
b. moving one of the stacked discrete pieces of stationery to an advanced holding position for subsequent insertion into the printing machine in response to the sensing of the absence of a discrete piece of stationery at that holding position;
c. sensing the presence of a discrete piece of stationery being emitted by the printing machine; and in response to such sensing
d. simultaneously effecting transport of the emitted piece of stationery from the printing machine to the stationery stack and insertion of the piece of stationery at the advanced position therefrom into the printing machine.

11. A method of feeding discrete unconnected envelopes or the like to a work process machine comprising the steps of:
a. providing a stack of envelopes,
b. intermittently feeding one envelope at a time to a ready position,
c. periodically releasing the envelope at the ready position so that it is transferred to the machine, and
d. automatically removing and feeding processed envelopes one at a time from the machine,
e. the envelope at the ready position being released in response to sensing the presence of an envelope being emitted from the machine.

12. A method of feeding discrete, unconnected envelopes or the like to a work process machine comprising the steps of:
a. providing a stack of envelopes,
b. intermittently removing one envelope at a time from the bottom of the stack in response to withdrawal of an envelope from the machine and feeding the envelope to a ready station,
c. periodically releasing an envelope at the ready station in response to sensing the presence of an envelope being emitted from the machine.
d. processing envelopes through the machine,
e. removing envelopes from the machine and transporting them to a receiving station.

13. Apparatus for feeding envelopes or the like to and from a work processing machine comprising:

a. magazine means for holding a stack of envelopes, b. means including a releasable gate defining a ready station, the machine being disposed to receive the envelopes released from the ready station, c. means for extracting one envelope at a time from the stack in response to envelopes withdrawn from the machine and transferring each extracted envelope to the ready station, d. means for receiving envelopes withdrawn from the machine and transferring the envelopes to a receiving station, and e. means for operating said gate to release an envelope in response to sensing the presence of an envelope being emitted from the machine.

* * * * *